US010042273B2

(12) United States Patent
Takahashi et al.

(10) Patent No.: US 10,042,273 B2
(45) Date of Patent: Aug. 7, 2018

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Koji Takahashi, Kashiwa (JP); Hideki Ogawa, Moriya (JP); Yasuhiro Kawai, Abiko (JP); Naoaki Ichihashi, Abiko (JP); Wataru Kitamura, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/315,869

(22) PCT Filed: Jul. 30, 2015

(86) PCT No.: PCT/JP2015/003843

§ 371 (c)(1),
(2) Date: Dec. 2, 2016

(87) PCT Pub. No.: WO2016/021161

PCT Pub. Date: Feb. 11, 2016

(65) Prior Publication Data

US 2017/0108790 A1 Apr. 20, 2017

(30) Foreign Application Priority Data

Jul. 24, 2015 (JP) ..... 2015-146721

(51) Int. Cl.
*G03G 5/147* (2006.01)
*G03G 5/04* (2006.01)

(52) U.S. Cl.
CPC ..... *G03G 5/147* (2013.01); *G03G 5/04* (2013.01)

(58) Field of Classification Search
CPC ..... G03G 5/14713; G03G 5/14717; G03G 5/14734; G03G 5/147; G03G 5/04; G03G 5/071
USPC ..... 430/66, 67
See application file for complete search history.

(56) References Cited

U.S. PATENT DOCUMENTS

| | | | |
|---|---|---|---|
| 5,876,890 | A | 3/1999 | Kitamura et al. |
| 5,912,098 | A | 6/1999 | Tanaka et al. |
| 6,405,005 | B1 | 6/2002 | Kitamura et al. |
| 7,097,953 | B2 | 8/2006 | Ogawa et al. |
| 7,645,547 | B2 | 1/2010 | Okuda et al. |
| 7,655,370 | B2 | 2/2010 | Kitamura et al. |
| 7,718,331 | B2 | 5/2010 | Uematsu et al. |
| 7,813,675 | B2 | 10/2010 | Tanabe et al. |
| 8,420,284 | B2 | 4/2013 | Ohshima et al. |
| 8,457,528 | B2 | 6/2013 | Ochi et al. |
| 8,783,209 | B2 | 7/2014 | Kaku et al. |
| 8,865,380 | B2 | 10/2014 | Noguchi et al. |
| 9,114,565 | B2 | 8/2015 | Kawai et al. |
| 9,389,521 | B2 | 7/2016 | Takahashi et al. |
| 2014/0004450 | A1 | 1/2014 | Tokimitsu et al. |
| 2014/0093281 | A1 | 4/2014 | Takahashi et al. |
| 2015/0286182 | A1 | 10/2015 | Mitsui et al. |
| 2016/0291488 | A1 | 10/2016 | Takahashi et al. |
| 2016/0327876 | A1 | 11/2016 | Miyauchi et al. |

FOREIGN PATENT DOCUMENTS

| | | |
|---|---|---|
| EP | 1 734 410 | 12/2006 |
| JP | 2007-233355 | 9/2007 |
| JP | 2009-020278 | * 1/2009 |
| JP | 2010-160184 | 7/2010 |
| JP | 2013-210594 | 10/2013 |
| WO | 2005/093518 | 10/2005 |
| WO | 2014/081046 | 5/2014 |

OTHER PUBLICATIONS

Diamond, A.S., ed. Handbook of Imaging Materials, Marcel Dekker, Inc., NY (1991), pp. 395-396.*
Japanese Patent Office J-PlatPat machine-assisted English-language translation of JP 2009-020278 (pub. Jan. 2009).*
U.S. Appl. No. 15/265,995, Mai Murakami, filed Sep. 15, 2016.
U.S. Appl. No. 15/413,758, Wataru Kitamura, filed Jan. 24, 2017.

* cited by examiner

*Primary Examiner* — Janis L Dote
(74) *Attorney, Agent, or Firm* — Fitzpatrick Cella Harper and Scinto

(57) ABSTRACT

In the electrophotographic photosensitive member of the present invention, a plurality of convex portions having a longest diameter L1 in the generatrix direction of the electrophotographic photosensitive member of 30 μm or more arid a height H1 of 1 μm or more are formed on the surface of the electrophotographic photosensitive member, a plurality of convex portions corresponding to the convex portions formed on the surface of the surface layer are formed at the interface between the surface layer and a layer immediately below the surface layer, and the rate of fitting of the convex portions formed on the surface of the surface layer to the convex portions formed at the interface between the surface layer and the layer immediately below the surface layer is 20% or more and 200% or less.

10 Claims, 6 Drawing Sheets

ELECTROPHOTOGRAPHIC PHOTOSENSITIVE MEMBER, PROCESS CARTRIDGE AND ELECTROPHOTOGRAPHIC APPARATUS

This application is a National Phase of PCT/JP2015/003843 filed Jul. 30, 2015, which in turn claims the benefit of Japanese Patent Application No. 2014-160434, filed Aug. 6, 2014 and Japanese Patent Application No. 2015-146721, filed Jul. 24, 2015 which are hereby incorporated by reference herein in their entirety.

TECHNICAL FIELD

The present invention relates to an electrophotographic photosensitive member, a process cartridge and an electrophotographic apparatus.

BACKGROUND ART

Since mechanical external forces such as charging and cleaning are applied to the surface of an electrophotographic photosensitive member, the surface is demanded to have durability (for example, wear resistance) to such external forces, As a technique in response to the demand, a technique has been conventionally known in which a resin (for example, curable resin) high in wear resistance is used on the surface layer of an electrophotographic photosensitive member.

On the other hand, the problem caused by an increase in wear resistance of the surface of an electrophotographic photosensitive member includes a reduction in cleanability due to a high coefficient of dynamic friction of the surface of an electrophotographic photosensitive member and a high rotary torque of the surface of an electrophotographic photosensitive member.

As a technique in response to the problem, PTL 1 describes a technique for providing a plurality of dimple-shaped concave portions on the surface (periphery) of an electrophotographic photosensitive member. Moreover, PTL 2 describes a technique for providing 76 or more and 1000 or less per 100 μm square of concave portions having an average long axis diameter of more than 3.0 μm and 14.0 μm or less on the surface of an electrophotographic photosensitive member.

In addition, PTL 3 describes an electrophotographic photosensitive member in which, when the surface roughness is expressed by RzJIS, the number of convex portions having a height of ½×RzJIS or more on the surface of the electrophotographic photosensitive member is 30 or more and 300 or less per 12 mm in measurement length, and describes an enhancement in cleaning performance resulting therefrom.

CITATION LIST

Patent Literature

PTL 1: WO 2005/093518

PTL 2: Japanese Patent Application Laid-open No. 2007-233355

PTL 3: Japanese Patent Application Laid-Open No. 2010-160184

SUMMARY OF INVENTION

Technical Problem

In the techniques described in PTLs 1 and 2, the effect of reducing the rotary torque of the electrophotographic photosensitive member is exerted, and therefore cleaning failure is hardly caused.

When the electrophotographic photosensitive member is used under a severe environment for cleaning, such as a low-temperature and low-humidity environment, however, toner slipping that is considered to be caused due to cleaning failure is caused, and therefore room for a further improvement remains.

In addition, it has also been round that it the technique described in PTL 3 is used, the effect of reducing the rotary torque of the electrophotographic photosensitive member is highly exerted and cleaning failure is hardly caused, but an image defect such as a blank area is generated on an image output after a long period of use. The reason is considered because the interface between a surface layer and a layer immediately below the surface layer (charge-transporting layer) is finely peeled off.

The present invention is directed to providing an electrophotographic photosensitive member that is excellent in cleanability and that hardly causes an image defect such as a blank area even after a long period of use, and a process cartridge and an electrophotographic apparatus including the electrophotographic photosensitive member.

Solution to Problem

According to one aspect of the present invention, there is provided an electrophotographic photosensitive member having cylindrical shape, the electrophotographic photosensitive member comprising a support and a surface layer formed on the support, and comprising a layer immediately below the surface layer, between the support and the surface layer, wherein a plurality of convex portions having a longest diameter L1 in a generatrix direction of the electrophotographic photosensitive member of 30 μm or more and a height H1 of 1 μm or more are formed on a surface of the electrophotographic photosensitive member, a plurality of convex portions corresponding to the convex portions formed on a surface of the surface layer are formed at an interface between the surface layer and the layer immediately below the surface layer, and a rate of fitting of the convex portions formed on the surface of the surface layer to the convex portions formed at the interface between the surface layer and the layer immediately below the surface layer is 20% or more and 200% or less.

According to another aspect of the present invention, there is provided a method for producing the electrophotographic photosensitive member of the present invention, the method including;

forming the surface layer immediately above the layer immediately below the surface layer to produce an object to be processed, and pressing a mold member having concave portions on a surface of the surface layer and rotating the object to be processed, to form a plurality of convex portions on the surface of the surface layer and to form a plurality of convex portions corresponding to the convex portions at an interface between the surface layer and the layer immediately below the surface layer.

According to further aspect of the present invention, there is provided a process cartridge detachably attachable to a main body of an electrophotographic apparatus, and integrally supporting the electrophotographic photosensitive member of the present invention and a cleaning unit having a cleaning member disposed in contact with the electrophotographic photosensitive member.

According to further aspect of the present invention, there is provided an electrophotographic apparatus including the electrophotographic photosensitive member of the present invention, and a charging unit, an exposure unit, a developing unit, a transferring unit and a cleaning unit having a cleaning member disposed in contact with the electrophotographic photosensitive member.

Advantageous Effects of Invention

The present invention can provide an electrophotographic photosensitive member that is excellent in cleanability and that hardly causes an image defect such as a blank area even after endurance over a long period of use, and a process cartridge and an electrophotographic apparatus including the electrophotographic photosensitive member.

Further features of the present invention will become apparent from the following description of exemplary embodiments with reference to the attached drawings.

DESCRIPTION OF EMBODIMENTS

Figure 1A:
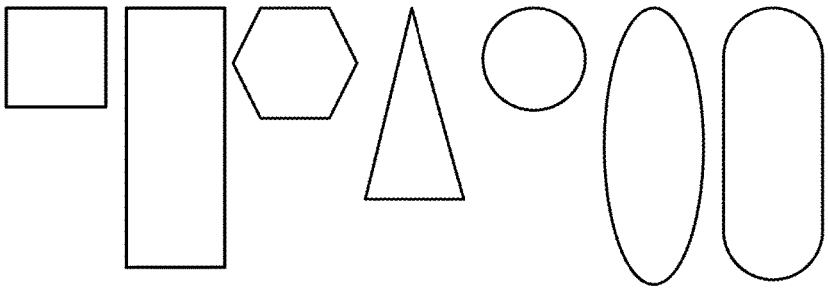
FIG. 1A is a view illustrating shape examples of convex portions on the surface of an electrophotographic photosensitive member.

Preferred embodiments of the present invention will now be described in detail in accordance with the accompanying drawings.

A plurality of convex portions having a longest diameter L1 in the generatrix direction of 30 μm or more and a height H1 of 1 μm or more are formed on the surface of the electrophotographic photosensitive member of the present invention, and a plurality of convex portions corresponding to the convex portions formed on the surface of the surface layer are also formed at the interface between the surface layer and a layer immediately below the surface layer. The respective convex portions are independent from each other. Then, the convex portions formed on the surface of the electrophotographic photosensitive member follow (fit) the convex portions formed at the interface. It has been found from such characteristics that generation of an image defect such as a blank area after a long period of use is remarkably reduced.

Mechanical external forces such as charging, developing, transferring and cleaning are directly applied to the electrophotographic photosensitive member. In the case where the surface of the electrophotographic photosensitive member has independent convex portions, a larger force due to the scarifying effect from a contact member acts on in the direction, in which the interface is peeled off, than the case where the surface has no convex portions and the case where the surface has independent concave portions. Examples of the contact member include a charging roller, a developing roller, a transferring roller and a cleaning blade.

The convex portions formed on the surface of the electrophotographic photosensitive member follow (fit) the convex portions formed at the interface between the surface layer of the electrophotographic photosensitive member and the layer immediately below the surface layer. It is considered that adhesiveness between the surface layer and the layer immediately below is thus increased to suppress fine peeling off of the interface after a long period of use. The present inventors consider that such a mechanism allows generation of an image defect such as a blank area after a long period of use to be suppressed.

Specifically, convex portions are provided on the surface of the electrophotographic photosensitive member so that the rate of fitting thereof to the convex portions formed at the interface is 20% or more and 200% or less.

The "generatrix direction" means a direction perpendicular to the rotation direction (circumferential direction) of the electrophotographic photosensitive member. When the electrophotographic photosensitive member is cylindrical, the "generatrix direction" is the same direction as the axis direction of the electrophotographic photosensitive member.

The convex portions formed on the surface of the electrophotographic photosensitive member and the convex portions formed at the interface can be observed by a microscope such as a laser microscope, an optical microscope, an electron microscope or an atomic force microscope.

For the laser microscope, for example, the following instruments can be utilized:

Super-depth shape measuring microscope VK-8550, super-depth shape measuring microscope VK-9000, and super-depth shape measuring microscopes VK-9500 and VK-X200 manufactured by Keyence Corporation;

Surface shape measuring system Surface Explorer SX-520DR Model manufactured by Ryoka Systems Inc.;

Scanning confocal laser microscope OLS3000 manufactured by Olympus Corporation; and Real color confocal microscope Oplitecs C130 manufactured by Lasertec Corporation.

For the optical microscope, for example the following instruments can be utilized:

Digital microscope VHX-500 and digital microscope VHX-200 manufactured by Keyence Corporation; and 3D digital microscope VC-7700 manufactured by OMRON Corporation.

For the electron microscope, for example, the following instruments can be utilized:

3D real surface view microscope VE-9800 and 3D real surface view microscope VE-8800G manufactured, by Keyence Corporation;

Scanning electron microscope Conventional/Variable Pressure SEM manufactured by Hitachi High-Tech Science Corporation; and Scanning electron microscope SUPERSCAN SS-550 manufactured by Shimadzu Corporation.

For the atomic force microscope, for example, the following instruments can be utilized:

Nanoscale hybrid microscope VN-8000 manufactured by Keyence Corporation;

Scanning probe microscope NanoNavi Station manufactured by Hitachi High-Tech Science Corporation; and Scanning probe microscope SPM-9600 manufactured by Shimadzu Corporation.

Hereinafter, the convex portions formed on the surface of the electrophotographic photosensitive member and the convex portions formed at the interface between the surface layer of the electrophotographic photosensitive member and the layer immediately below the surface layer, the rate of fitting, and the like are described.

First, when the surface of the electrophotographic photosensitive member is viewed from the normal direction (above), examples of the shapes of the convex portions in the present invention include shapes configured by straight lines, shapes configured by curved line(s), and shapes configured by straight line(s) and curved line(s), as illustrated in FIG. 1A.

Figure 1B:
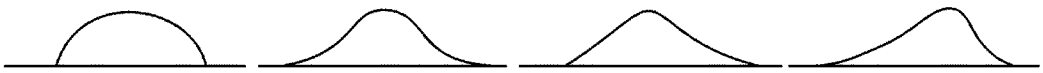
FIG. 1B is a view illustrating shape examples of convex portions on the surface of an electrophotographic photosensitive member.

Moreover, when the cross section of the electrophotographic photosensitive member is observed, examples include shapes configured by curved line(s), as illustrated in FIG. 1B.

Convex portions having a different shape and convex portions having a different size may coexist on the surface (the surface of the surface layer) of the electrophotographic photosensitive member.

The convex portions formed on the surface of the electrophotographic photosensitive member of the present invention and the convex portions formed at the interlace between the surface layer and the layer immediately below the surface layer are independent convex portions. The independent convex portions mean that individual convex portions are present in the state of being distinguished from other convex portions.

Figure 2A:
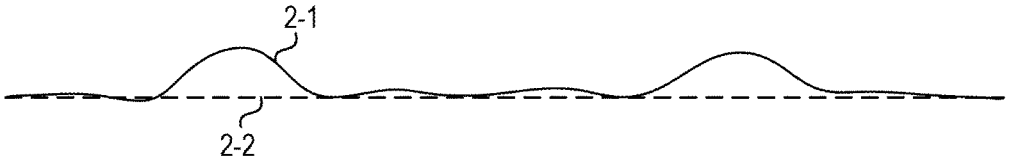
FIG. 2A is a view schematically illustrating a relationship among, for example, a reference surface, convex portions, the longest diameters L1 in the generatrix direction of convex portions, and the heights H1 of convex portions.

Specifically, the cross section in the generatrix direction (axis direction) and the cross section in the rotation direction (circumferential direction) of the surface of the electrophotographic photosensitive member are magnified and observed by a microscope. When the surface (periphery) of the electrophotographic photosensitive member is a curved surface curved in the rotation direction (circumferential direction), for example, when the electrophotographic photosensitive member is cylindrical, the cross section profile of the curved surface is extracted and overlapped with a curved line (circle when the electrophotographic photosensitive member is cylindrical). FIG. 2A illustrates an example in which the profile is overlapped with a curved line. The example illustrated in FIG. 2A is an example where the electrophotographic photosensitive member is cylindrical. In FIG. 2A, a solid line 2-1 illustrates an example of the cross section profile of the surface (curved surface) of the electrophotographic photosensitive member, and a dashed line 2-2 is the curved line with which the cross section profile 2-1 is overlapped. The cross section profile 2-1 is corrected so that the curved line 2-2 is a straight line, and a surface obtained by expanding the resulting straight line in the longitudinal direction (which is a direction perpendicular to the rotation direction (circumferential direction); when the electrophotographic photosensitive member is cylindrical, the direction is the same direction as the axis direction of the electrophotographic photosensitive member) of the electrophotographic photosensitive member is defined as the reference surface. Also when the electrophotographic photosensitive member is not cylindrical, the reference surface is obtained as in the case where the electrophotographic photosensitive member is cylindrical.

Figure 2B:
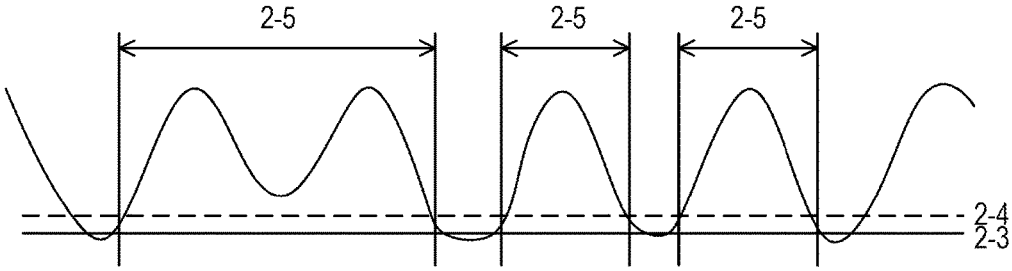
FIG. 2B is a view schematically illustrating a relationship among, for example, a reference surface, convex portions, the longest diameters L1 in the generatrix direction of convex portions, and the heights H1 of convex portions.

As illustrated in FIG. 2B, a surface that is located above the resulting reference surface 2-3 by 0.1 μm and that is in parallel with the reference surface is defined as a second reference surface 2-4. Then, portions located above the second reference surface 2-4 are determined as convex portions (independent convex portions) 2-5.

Figure 2C:
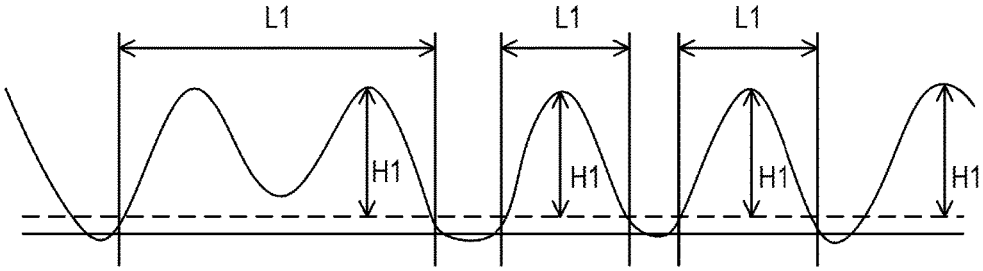
FIG. 2C is a view schematically illustrating a relationship among, for example, a reference surface, convex portions, the longest diameters L1 in the generatrix direction of convex portions, and the heights H1 of convex portions.

The longest diameters in the generatrix direction and the heights of individual convex portions are calculated from the profile of the surface on which convex portions are formed, which are convex portions determined as independent convex portions by the above method. The calculation method is illustrated in FIG. 2C. The longest diameters L1 in the generatrix direction of convex portions are each a distance between intersections with the second reference surface on the profile passing through the peak of each convex portion. The heights of convex portions are each the longest distance from the second reference surface on the profile passing through the peak of each convex portion.

Figure 3A:
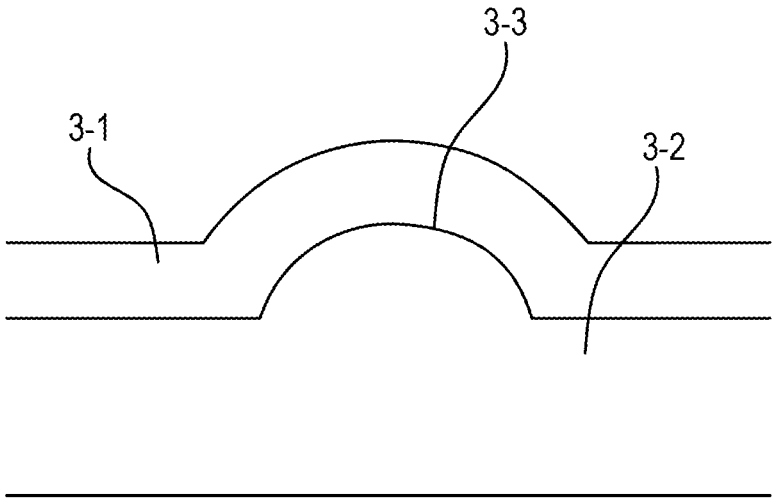
FIG. 3A is a view schematically illustrating a convex portion formed at the interface between a surface layer and a layer immediately below the surface layer.

The convex portions formed at the interface between the surface layer and the layer immediately below the surface layer are located at an interface (3-3) between a second charge-transporting layer (3-1) and a charge-transporting layer (3-2), for example, as illustrated in FIG. 3A, and the rate of fitting is calculated by the following expression. In the example, the second charge-transporting layer corresponds to the surface layer and the charge-transporting layer corresponds to the layer immediately below the surface layer.

$$H2/H1' \times 100$$

Hereinafter, the method of determining H1' and H2 is described.

Figure 3B:
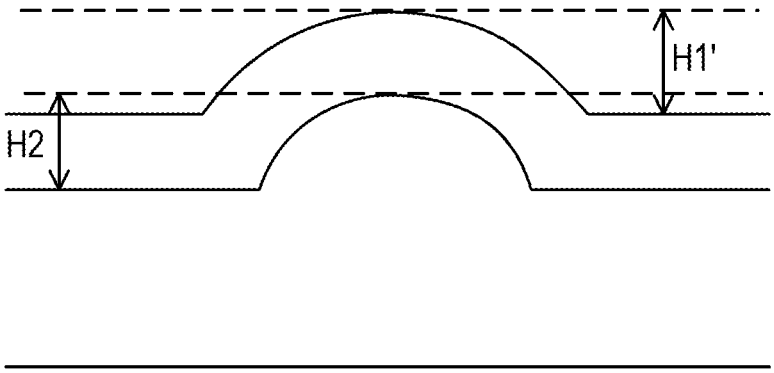
FIG. 3B is a view schematically illustrating a convex portion formed at the interface between a surface layer and a layer immediately below the surface layer.

First, a sample of about 5 mm square is arbitrarily cut out at several points in the surface of the electrophotographic photosensitive member. The cross section thereof is roughly processed by a trimmer, and then set by an argon ion beam and observed, and therefore the H1' and H2 illustrated in FIG. 3B are measured. The H1' represents the distance between the peak of each of the convex portions on the surface-layer and the reference surface (flat surface). The H2 represents a distance between the flat surface of the layer immediately below the surface layer and the peak of each of the convex portions formed, corresponding to the convex portions on the surface layer, at the interface between the surface layer and the layer immediately below the surface layer. The flat surface of the layer immediately below the surface layer corresponds to the interface, formed following the reference surface (flat surface) of the surface layer, between the surface layer and the layer immediately below the surface layer.

The convex portions may be formed on the entire surface of the electrophotographic photosensitive member, or may be formed on a part of the surface of the electrophotographic photosensitive member. When the convex portions are formed on a part of the surface of the electrophotographic photosensitive member, the convex portions can be formed in at least a region in contact with the cleaning member. The rate of fitting preferably satisfies 20% or more and 200% or less, more preferably 50% or more and 100% or less in ail the convex portions from the viewpoint of an increase in adhesiveness at the interface between the surface layer and the layer immediately below the surface layer.

When the thickness of the surface layer is defined as T, the relationship between the longest diameter L1 in the generatrix direction of each of the convex portions formed on the surface of the surface layer and T preferably satisfies $3 \leq L1/T \leq 22$, more preferably satisfies $4 \leq L1/T \leq 20$ from the viewpoints of maintenance of adhesiveness and relief of external forces.

The thickness of the surface layer is preferably 0.1 μm or more and 30 μm or less, more preferably 1 μm or more and 10 μm or less.

The ratio of the area of the convex portions on the surface of the surface layer of the electrophotographic photosensitive member to the area of the surface of the surface layer can be 30% or more and 70% or less.

<Method for Forming Convex Portions on Surface of Electrophotographic Photosensitive Member>

A mold member (hereinafter, referred to as "mold".) having concave portions corresponding to the convex portions to be formed can be brought into pressure-contact with the surface of the electrophotographic photosensitive member for performing shape transfer, thereby forming convex portions on the surface of the electrophotographic photosensitive member.

In order to form convex portions on the surface of the electrophotographic photosensitive member, first, a surface layer is formed immediately above a layer immediately below the surface layer (surface layer formation step). Next, the mold member having concave portions is pressed on the surface of the electrophotographic photosensitive member, on which the surface layer is formed. Then, the electrophotographic photosensitive member is rotated to transfer convex portions onto the surface of the electrophotographic photosensitive member and to form a plurality of convex portions corresponding to the convex portions at the interface with the layer immediately below the surface layer.

Figure 4:
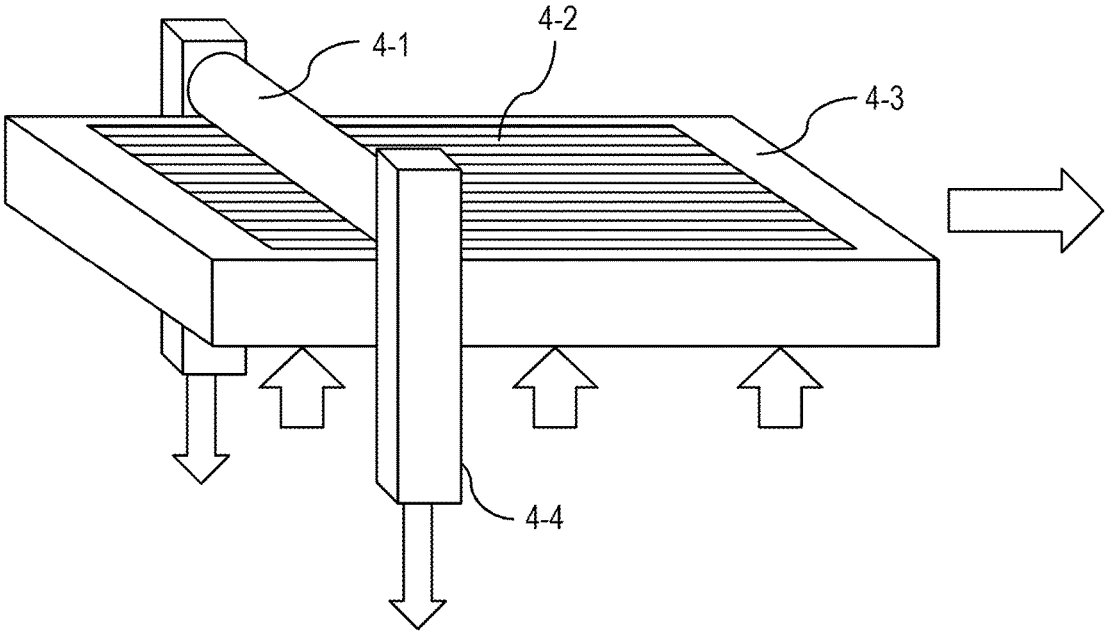
FIG. 4 is a view illustrating an example of a pressure-contact shape transfer processing apparatus that forms convex portions on the surface of an electrophotographic photosensitive member.

FIG 4 illustrates one example of a pressure-contact shape transfer processing apparatus that forms convex portions on the surface of the electrophotographic photosensitive member.

The method for forming convex portions on the surface of the electrophotographic photosensitive member by using the pressure-contact shape transfer processing apparatus illustrated in FIG. 4 is as follows.

While an object to be processed (electrophotographic photosensitive member before formation of convex portions on the surface) 4-1 is rotated, a mold 4-2 is continuously brought into contact with the surface (periphery) of the object to be processed, for pressurizing, thereby enabling to form convex portions and fiat portions on the surface of the object to be processed 4-1. An electrophotographic photosensitive member having convex portions on the surface thereof can be thus produced.

Examples of the material of a pressure member 4-3 include a metal, a metal oxide, a plastic and a glass. In particular, stainless steel (SUS) can be adopted in terms of mechanical strength, dimensional precision and durability. The mold is placed on the upper surface of the pressure member 4-3. Moreover, a support member (not illustrated) and a pressure system (not illustrated) located closer to the lower surface thereof can allow the mold 4-2 to be brought into contact with the surface of the object to be processed 4-1 supported by a support member 4-4 at a predetermined pressure. The support member 4-4 may be pressed on the pressure member 4-3 at a predetermined pressure, or the support member 4-4 and the pressure member 4-3 may be pressed on each other.

The example illustrated in FIG. 4 is an example in which the pressure member 4-3 is moved to thereby continuously process the surface of the object to be processed 4-1 while allowing the object to be processed 4-1 to be rotated in a driven or driving manner. Furthermore, the pressure member 4-3 is secured and the support member 4-4 is moved, or both the support member 4-4 and the pressure member 4-3 are moved, to thereby enable to continuously process the surface of the object to be processed 4-1.

Herein, the mold 4-2 and the object to be processed 4-1 can be heated from the viewpoint of effectively performing shape transfer.

Examples of the mold include a metal and a resin film subjected to fine surface processing. In addition, examples also include a silicon wafer or the like whose surface is patterned by a resist, a resin film in which fine particles are dispersed, and a resin film having a fine surface shape, coated with a metal.

An elastic member can be placed between the mold and the pressure member from the viewpoint of uniforming the pressure to be applied to the electrophotographic photosensitive member.

<Configurations of Process Cartridge and Electrophotographic Apparatus>

Figure 5:
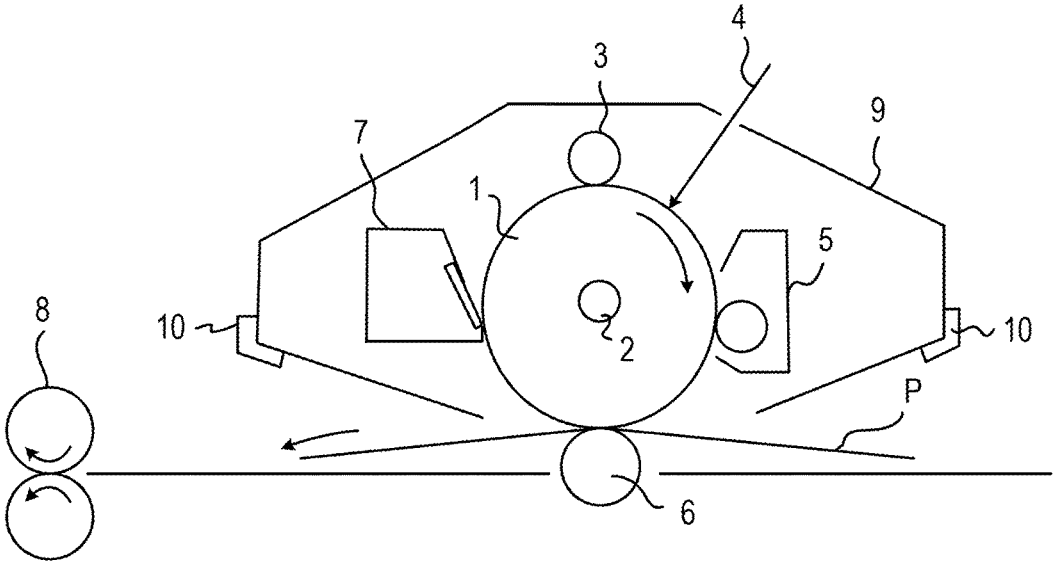
FIG. 5 is a view illustrating an example of an electrophotographic apparatus provided with a process cartridge including the electrophotographic photosensitive member of the present invention.

FIG. 5 illustrates an example of an electrophotographic apparatus provided with a process cartridge having the electrophotographic photosensitive member of the present invention.

In FIG. 5, a cylindrical electrophotographic photosensitive member 1 is rotatably driven at a predetermined peripheral speed (process speed) about a shaft 2 in the arrow direction. The surface of the electrophotographic photosensitive member 1 is uniformly charged to a predetermined positive or negative potential by a charging unit 3 (primary charging unit: for example, charging roller) in the course of rotation. Next, the surface charged of the electrophotographic photosensitive member 1 is irradiated with exposure light (image exposure light) 4 from an exposure unit (image exposure unit) (not illustrated), and an electrostatic latent image is formed according to image information intended. The exposure light 4 is light intensity-modulated according to a time-series electric digital image signal of image information intended, the light being output from an image exposure unit such as a slit exposure unit or a laser beam scanning exposure unit.

The electrostatic latent image formed on the surface of the electrophotographic photosensitive member 1 is developed (regularly developed or reversely developed) by a developer (toner) accommodated in a developing unit 5, and a toner image is formed on the surface of the electrophotographic photosensitive member. The toner image formed on the surface of the electrophotographic photosensitive member 1 is transferred on a transfer material P by a transfer bias from a transferring unit (for example, transferring roller) 6. The transfer material P is here taken out from a transfer material-feeding unit (not illustrated) in synchronization with the rotation of the electrophotographic photosensitive member 1, and fed to a portion (abutting portion) between the electrophotographic photosensitive member 1 and the transferring unit 6. In addition, a bias voltage having a reverse polarity to the charge retained by the toner is applied to the transferring unit from a bias power source (not illustrated).

The transfer material P, on which the toner image is transferred, is separated from the surface of the electrophotographic photosensitive member, conveyed to a fixing unit 8, subjected to a fixing treatment of the toner image, and thus discharged as an image forming product (print, copy) outside the electrophotographic apparatus.

The surface of the electrophotographic photosensitive member 1, from which the toner image has been transferred on the transfer material P, is cleaned by removal of an adhering material such as a developer remaining after transfer (transfer residual toner) by a cleaning unit disposed in contact with the electrophotographic photosensitive member.

Furthermore, the surface of the electrophotographic photosensitive member 1 is irradiated with pre-exposure light from a pre-exposure unit (not illustrated), subjected to neutralization and thereafter repeatedly used for image formation. Herein, when the charging unit 3 is a contact charging unit using a charging roller or the like as illustrated in FIG. 5, the pre-exposure unit is not necessarily needed.

In the present invention, a plurality of constituent elements among constituent elements such as the electrophotographic photosensitive member 1, the charging unit 3, the developing unit 5 and the cleaning unit 7 may be accommodated in one container to form a process cartridge integrally supporting such a plurality of constituent elements. The process cartridge can be configured to be detachably attachable to the main body of an electrophotographic apparatus. For example, a cartridge is formed which integrally supports the electrophotographic photosensitive member 1, and at least one selected from the group consisting of the charging unit 3, the developing unit 5 and the cleaning unit 7. Then, a guide unit 10 such as a rail of the main body of an electrophotographic apparatus can be used to form a process cartridge 9 detachably attachable to the main body of the electrophotographic apparatus.

When the electrophotographic apparatus is a copier or a printer, the exposure light 4 may be light reflected or transmitted from an original manuscript. Alternatively, the exposure light 4 may be light radiated by reading of an original manuscript by a sensor for conversion to signals, and scanning of a laser beam, driving of an LED array, driving of a liquid crystal shutter array, or the like performed according to the signals.

<Configuration of Electrophotographic Photosensitive Member>

The electrophotographic photosensitive member is generally an electrophotographic photosensitive member including a support and a photosensitive layer formed on the support. Moreover, the shape of the electrophotographic photosensitive member is generally cylindrical.

The photosensitive layer may be a monolayer type photosensitive layer containing a charge-transporting material and a charge-generating material in the same layer, or may be a laminated-type (functional separation type) photosensitive layer in which a charge-generating layer containing a charge-generating material and a charge-transporting layer containing a charge-transporting material are separated. The laminated-type photosensitive layer can be adopted in terms of electrophotographic properties. In addition, the laminated-type photosensitive layer can be an orderly laminated-type photosensitive layer in which the charge-generating layer and the charge-transporting layer in this order are laminated on the support from the support side. The charge-generating layer may have a laminated structure, or the charge-transporting layer may have a laminated structure.

The support can be one exhibiting electro-conductivity (electro-conductive support). Examples of the material of the support include metals (alloys) such as iron, copper, gold, silver, aluminum, zinc, titanium, lead, nickel, tin, antimony, indium, chromium, an aluminum alloy and stainless steel. For example, a metallic support or a plastic support having a coating film formed by vacuum vapor deposition using aluminum, an aluminum alloy or an indium oxide-tin oxide alloy can also be used.

A support formed by impregnating a plastic or paper with an electro-conductive particle such as carbon black, a tin oxide particle, a titanium oxide particle or a silver particle, or a support formed by an electro-conductive binder resin can also be used.

The surface of the support may be subjected to, for example, a cutting treatment, a surface-roughening treatment or an alumite treatment for the purpose of suppression of interference fringes due to laser light scattering.

An electro-conductive layer may also be provided between the support and an undercoat layer described later, for example, for the purposes of suppression of interference fringes due to laser light scattering and covering of scratches of the support. The electro-conductive layer can be formed by forming a coating film by coating of a coating liquid for an electro-conductive layer, the liquid being obtained by a dispersing treatment of an electro-conductive material such as carbon black, an electro-conductive pigment or a resistance-regulating pigment together with a binder resin in a solvent, and drying the resulting coating film. In addition, a compound to be cured by polymerization by, for example, heating, ultraviolet irradiation or radiation, irradiation may also be added to the coating liquid for an electro-conductive layer.

Examples of the binder resin for use in the electro-conductive layer include an acrylic resin, an allyl resin, an alkyd resin, an ethylcellulose resin, an ethylene-acrylic acid copolymer, an epoxy resin, a casein resin, a silicone resin, a gelatin resin, a phenol resin, a butyral resin, a polyacrylate resin, a polyacetal resin, a polyamideimide resin, a polyamide resin, a polyallylether resin, a polyimide resin, a polyurethane resin, a polyester resin, a polycarbonate resin and a polyethylene resin.

Examples of the electroconductive pigment and the resistance-regulating pigment include particles of metals (alloys) such as aluminum, zinc, copper, chromium, nickel, silver and stainless steel, and such metals (alloys) vapor-deposited on the surface of a plastic particle. Particles of metal oxides such as zinc oxide, titanium oxide, tin oxide, antimony oxide, indium oxide, bismuth oxide, indium oxide doped with tin and tin oxide doped with antimony or tantalum can also be used.

The electro-conductive material may be used singly or in combinations of two or more. Furthermore the electro-conductive pigment and the resistance-regulating pigment can be subjected to a surface treatment. Examples of the surface treatment agent include a surfactant, a silane coupling agent and a titanium coupling agent.

Furthermore, a particle such as a silicone resin fine particle and an acrylic resin fine particle may also be added for the purpose, of light scattering. In addition, an additive such as a levelling agent, a dispersant, an antioxidant, an ultraviolet absorber, a plasticizer or a rectifying material may also be contained.

The thickness of the electro-conductive layer is preferably 0.2 μm or more and 40 μm or less, more preferably 1 μm or more and 35 μm or less, more preferably 5 μm or more and 30 μm or less.

An undercoat layer (intermediate layer) may also be provided between the support or the electro-conductive layer arid the photosensitive layer (charge-generating layer, charge-transporting layer) for the purposes of an improvement in adhesion property of the photosensitive layer and an improvement in charge injection property from the support. The undercoat layer can be formed by forming a coating film by coating of a coating liquid for an undercoat layer, the liquid being obtained by mixing of a binder resin and a solvent, and drying the coating film.

Examples of the resin for use in the undercoat layer include polyvinyl alcohol, polyethylene oxide, ethylcellulose, methylcellulose, casein, polyamides (nylon 6, nylon 66, nylon 610, copolymerized nylon, N-alkoxymethylated nylon and the like), a polymethane resin, an acrylic resin, an allyl resin, an alkyd resin, a phenol resin and an epoxy resin.

The thickness of the undercoat layer can be 0.05 μm or more and 40 μm or less.

A metal oxide particle may also be contained in the undercoat layer. Examples of the metal oxide particle for use in the undercoat layer include a particle containing at least one metal oxide selected from the group consisting of titanium oxide, zinc oxide, tin oxide, zirconium oxide and aluminum oxide. For the metal oxide-containing particle, a zinc oxide-containing particle can be adopted.

The metal oxide particle may also be a metal oxide, particle whose surface is treated with a surface treatment agent such as a silane coupling agent.

Examples of the dispersing method include a method using a homogenizer, an ultrasonic disperser, a ball mill, a sand mill, a roll mill, a vibrational mill, an attritor or a liquid collision type high-speed disperser.

An organic resin particle and a leveling agent may also be further contained in the undercoat layer for the purposes of, for example, adjustment of the surface roughness of the undercoat layer and suppression of cracking of the undercoat layer. For the organic resin particle, a hydrophobic organic resin particle such as a silicone particle or a hydrophilic organic resin particle such as a crosslinked polymethacrylate resin (PMMA) particle can be used.

Various additives can be contained in the undercoat layer. Examples of the additives include metals, and organometallic compounds such as an electro-conductive material, an electron-transporting material, a metal chelate compound and a silane coupling agent.

When the photosensitive layer is a laminated-type photosensitive layer, the charge-generating layer can be formed by forming a coating film by coating of a coating liquid for a charge-generating layer, the liquid being obtained by dispersing of a charge-generating material together with a binder resin in a solvent, and drying the coating film. The charge-generating layer may also be a film formed by vapor deposition of the charge-generating material.

Examples of the charge-generating material for use in the photosensitive layer include an a so pigment, a phthalocyanine pigment, an indigo pigment, a perylene pigment, a polycyclic quinone pigment, a squarylium dyestuff, a thiapyrylium salt, a triphenylmethane dyestuff and a quinacridone pigment. Examples also include an azlenium salt pigment, a cyanine dye, an anthanthrone pigment, a pyranthrone pigment, a xanthene dyestuff, a quinonimine dyestuff and a styryl dyestuff.

Such charge-generating materials may be used singly or in combinations of two or more. In particular, oxytitanium phthalocyanine, chlorogallium phthalocyanine and hydroxygallium phthalocyanine can be adopted in terms of sensitivity. Furthermore, for hydroxygallium phthalocyanine, a hydroxygallium phthalocyanine crystal of a crystal form having peaks at Bragg angles 2θ of 7.4°±0.3° and 28.2°±0.3° in CuKα characteristic X-ray diffraction can be adopted.

Examples of the binder resin for use in the charge-generating layer include a polycarbonate resin, a polyester resin, a butyral resin, a polyvinyl acetal resin, an acrylic resin, a vinyl acetate resin and a urea resin. In particular, a butyral resin can be adopted. Such resins can be used singly, or as a mixture or a copolymer of two or more.

Examples of the dispersing method include a method using a homogenizer, an ultrasonic disperser, a ball mill, a sand mill, a roll mill or an attritor.

With respect to the ratio of the charge-generating material to the binder resin in the charge-generating layer, the amount of the charge-generating material can be 0.3 parts by mass or more and 10 parts by mass or less based on 1 part by mass of the binder resin. For example, a photosensitizer, a leveling agent, a dispersant, an antioxidant, an ultraviolet absorber, a plasticizer and a rectifying material can also be if necessary added to the charge-generating layer. The thickness of the charge-generating layer is preferably 0.01 μm or more and 5 μm or less, more preferably 0.1 μm or more and 2 μm or less.

When the photosensitive layer is a laminated-type photosensitive layer, a charge-transporting layer is formed on the charge-generating layer. The charge-transporting layer can be formed by forming a coating film by coating of a coating liquid for a charge-transporting layer, the liquid being obtained by dissolution of a charge-transporting material and a binder resin in a solvent, and drying the coating film.

Examples of the charge-transporting material include a pyrene compound, an N-alkylcarbazole compound, a hydra zone compound, an N, N-dialkylaniline compound, a diphenylamine compound, a triphenylamine compound, a triphenylmethane compound, a pyrazoline compound, a styryl compound, a stilbene compound and a butadiene compound. Such charge-transporting materials may be used singly or in combinations of two or more. Among such charge-transporting materials, a triphenylamine compound can be adopted in terms of charge mobility.

Examples of the binder resin for use in the charge-transporting layer include a polyester resin, an acrylic resin, a polyvinyl carbazole resin, a phenoxy resin, a polycarbonate resin, a polyvinyl butyral resin, a polystyrene resin, a polyvinyl acetate resin, a polysulfone resin, a polyallylate resin, vinylidene chloride, an acrylonitrile copolymer and a polyvinyl benzal resin. Such binder resins can be used singly, or as a mixture or a copolymer of two or more.

For example, an antioxidant, an ultraviolet absorber, a plasticizer and a leveling agent can also be if necessary added to the charge-transporting layer.

With respect to the ratio of the charge-transporting material to the binder resin in the charge-transporting layer, the amount of the charge-transporting material can be 0.3 parts by mass or more and 10 parts by mass or less based on 1 part by mass of the binder resin. When the charge-transporting layer is a monolayer, the thickness of the charge-transporting layer is preferably 5 μm or more and 40 μm or less, more preferably 8 μm or more and 30 μm or less. When the charge-transporting layer has a laminated structure, the thickness of the charge-transporting layer located closer to the support can be 5 μm or more and 30 μm or less, and the thickness of the charge-transporting layer located closer to the surface can be 1 μm or more and 10 μm or less.

Examples of the solvents for use in the coating liquid for a charge-generating layer and the coating liquid for a charge-transporting layer include an alcohol type solvent, a sulfoxide type solvent, a ketone type solvent, an ether type solvent, an ester type solvent, a halogenated hydrocarbon type solvent and an aromatic solvent.

A protective layer may also be formed on the charge-transporting layer for the purpose of enhancements in wear resistance and cleanability of the electrophotographic photosensitive member. The protective layer can be formed by forming a coating film by coating of a coating liquid for a protective layer, the liquid being obtained by dissolution of a binder resin in a solvent, and drying the coating film.

Examples of the resin for use in the protective layer include a polyvinyl butyral resin, a polyester resin, a polycarbonate resin, a polyamide resin, a polyimide resin, a polyurethane resin, a phenol resin and a polyallylate resin.

The protective layer may also be formed by forming a coating film by coating of a coating liquid for a protective layer, the liquid being obtained by dissolution of a polymerizable monomer or oligomer in a solvent, and subjecting the coating film to curing (polymerization) using a cross-linking or polymerization reaction. That is, the protective layer may also be a cured layer. Examples of the polymerizable monomer or oligomer include a compound having a chain-polymerizable functional group such as an acryloyloxy group or a styryl group. Examples also include a compound having a sequential polymerizable functional group such as a hydroxy group, an alkoxysilyl group, an isocyanate group or an epoxy group.

Examples of the curing reaction include radical polymerization, ion polymerization, heat polymerization, photo polymerization, radiation polymerization (electron beam polymerization), a plasma CVD method and a photo-CVD method.

An electro-conductive particle and a charge-transporting material may also be added to the protective layer. For the electro-conductive particle, for example, the electro-conductive material for use in the above electro-conductive layer can be used. For the charge-transporting material, the above charge-transporting material can be used.

Furthermore, from the viewpoint of simultaneously satisfying wear resistance and charge-transporting ability, a charge-transporting material having a polymerizable functional group is more preferably used. The polymerizable functional group can be an acryloyloxy group. Moreover, a charge-transporting material having two or more polymerizable functional groups in the same molecule can be adopted.

An organic resin particle and an inorganic particle may also be contained in the surface layer (charge-transporting layer or protective layer) of the electrophotographic photosensitive member. The organic resin particle includes a fluorine atom-containing resin particle and an acrylic resin particle. The inorganic particle includes an alumina particle, a silica particle and a titania particle. Furthermore, an electro-conductive particle, an antioxidant, an ultraviolet absorber, a plasticizer, a leveling agent and the like may also be added.

The thickness of the protective layer is preferably 0.1 μm or more and 30 μm or less, more preferably 1 μm or more and 10 μm or less.

Examples of the coating method of the coating liquid for each of the layers include a dip coating method, a spray coating method, a spinner coating method, a roller coating method, a Mayer bar coating method and a blade coating method.

EXAMPLES

Hereinafter, the present invention is described with reference to specific Examples in more detail. Herein, "part(s)" in Examples means "part(s) by mass". Moreover, hereinafter, the electrophotographic photosensitive member is also simply referred to as "photosensitive member". In addition, in each of photosensitive member-1 to photosensitive member-20,photosensitive member-23 to photosensitive member-26 and photosensitive member-104 to photosensitive member-105, the shapes of convex portions formed on the surface of the electrophotographic photosensitive member, when observed from above, were each a substantially circular shape in which the longest diameter in the generatrix direction and the longest diameter in the circumferential direction were substantially the same. In addition, in each of photosensitive member-1 to photosensitive member-26 and photosensitive member-104 to photosensitive member-105, the respective convex portions were formed whose shapes were substantially the same (the longest diameters in the generatrix direction were substantially the same, the longest diameters in the circumferential direction were substantially the same, and the heights were substantially the same).

(Production Example of Photosensitive Member-1)

An aluminum cylinder having a diameter of 30 mm and a length of 357.5 mm was used as the support (cylindrical support).

Next, 100 parts of a zinc oxide particle (specific surface area: 19 $m^2/g$, powder resistance: $4.7\times10^6\Omega\cdot cm$) as a metal oxide was mixed with 500 parts of toluene under stirring, and 0.8 parts of a silane coupling agent (compound name; N-2-(aminoethyl)-3-aminopropylmethyldimethoxysilane, trade name: KBM602, produced by Shin-Etsu Chemical Co, Ltd.) was added thereto and stirred for 6 hours. Thereafter, toluene was distilled off under reduced pressure and the resultant was heated and dried at 130° C. for 6 hours to provide a zinc oxide particle surface-treated.

Next, 15 parts of a butyral resin (trade name; BM-1, produced by Sekisui Chemical Co., Ltd.) as a polyol resin and 15 parts of blocked isocyanate (trade name: Suraldur 3175, produced by Sumitomo Bayer Urethane Co., Ltd.) were dissolved in a mixed solution of 73.5 parts of methyl ethyl ketone and 73.5 parts of 1-butanol. The zinc oxide particle surface-treated (80.8 parts) and 0.8 parts of 2,3,4-trihydroxybenzophenone (produced by Tokyo Chemical Industry Co., Ltd.) were added to the solution, and dispersed by a sand mill apparatus using glass beads having a diameter of 0.8 mm in an atmosphere of 23±3° C. for 3 hours. After the dispersing, 0.01 parts of a silicone oil (trade name: SH28PA, produced by Dow Corning Toray Co., Ltd.) and 5,6 parts of a cross linked polymethyl methacrylate (PMMA) particle (trade name: TECHPOLYMER SSX-102, produced by Sekisui Plastics Co., Ltd., average primary particle size: 2.5 μm) were added thereto and stirred to prepare a coating liquid for an undercoat layer.

The support was dip-coated with the coating liquid for an undercoat layer, and the resulting coating film was dried at 160° C. for 4.0 minutes to form an undercoat layer having a thickness of 18 μm.

Next, 20 parts of a hydroxygallium phthalocyanine crystal (charge-generating material) of a crystal form having peaks at Bragg angles 2 θ±0.2° of 7.4° and 28.2° in CuKα characteristic X-ray diffraction, 0.2 parts of a calixarene compound represented by the following formula (A),

[Chem. 1]

(A)

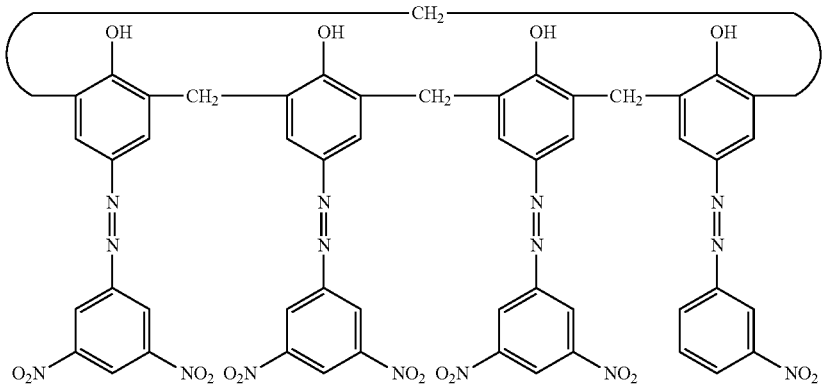

10 parts of polyvinyl butyral (trade name: S-Lec BX1, produced by Sekisui Chemical Co., Ltd.) and 600 parts of cyclohexanone were loaded to a sand mill using glass beads having a diameter of 1 mm, and subjected to a dispersing treatment for 4 hours. Thereafter, 700 parts of ethyl acetate was added thereto to thereby prepare a coating liquid for a charge-generating layer. The undercoat layer was dip-coated with the coating liquid for a charge-generating layer, and the resulting coating film was dried at 80° C. for 15 minutes to thereby form a charge-gene rating layer having a thickness of 0.17 μm.

Next, 30 parts of a compound (charge-transporting material) represented by the following formula (B), 60 parts of a compound (charge-transporting material) represented by the following formula (C), 10 parts of a compound represented by the following formula (D),

[Chem. 2]

(B)

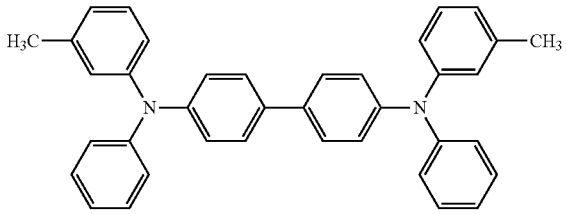

(C)

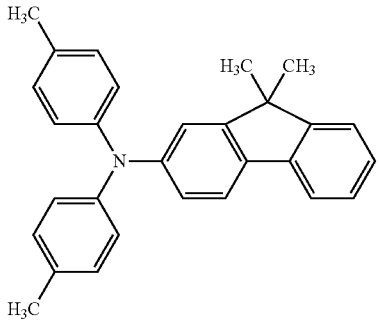

-continued (D)

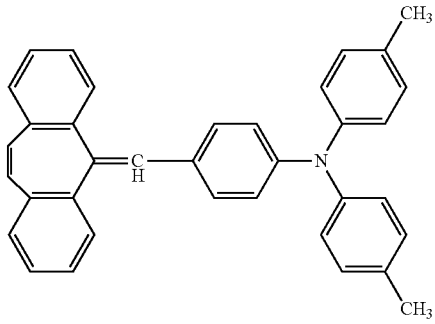

100 parts of a polycarbonate resin (trade name: Lupilon Z400, produced by Mitsubishi Engineering-Plastics Corporation, bisphenol Z type polycarbonate) and 0.02 parts of polycarbonate (viscosity average molecular weight Mv; 20000) represented by the following formula (E)

[Chem. 3]

(E)

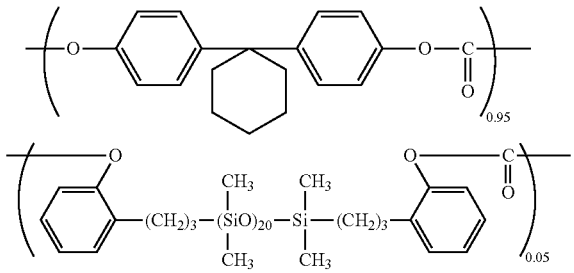

were dissolved, in a mixed solvent of 600 parts of mixed xylene and 200 parts of dimethoxumethane to prepare a coating liquid for a charge-transporting layer. The charge-generating layer was dip-coated with the coating liquid for a charge-transporting layer to form a coating film, and the resulting coating film was dried at 100° C. for 30 minutes to thereby form a charge-transporting layer having a thickness of 18 μm.

Next, a mixed solvent of 20 parts of 1,1,2,2,3,3,4-heptafluorocyclopentane (trade name: Zeorola H, produced by Zeon Corporation)/20 parts of 1-propanol was subjected to filtration by a polyflon filter (trade name: PF-040, produced by Toyo Roshi Kaisha, Ltd.). Thereafter, 90 parts of a hole-transporting compound represented by the following formula (F),

[Chem. 4]

(F)

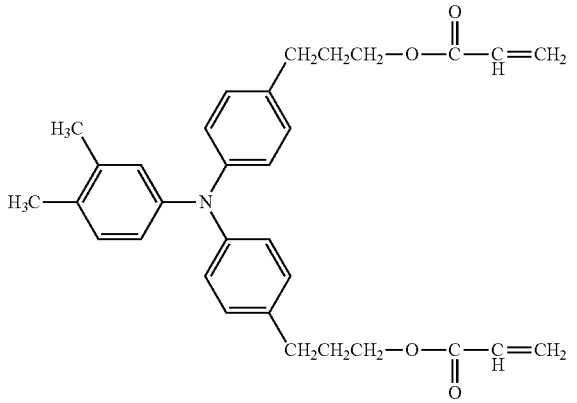

70 parts of 1, 1, 2, 2, 3, 3, 4-heptafluorocyclopentane and 70 parts of propanol were added to the mixed solvent. The resultant was filtered by a polyflon filter (trade name: PF-020, produced by Toyo Roshi Kaisha, Ltd.) to thereby prepare a coating liquid for a second charge-transporting layer (protective layer). The charge-transporting layer was dip-coated with the coating liquid for a second charge-transporting layer, and the resulting coating film was dried in the atmosphere at 50° C. for 6 minutes. Thereafter, while the support (object to be irradiated) was rotated at 200 rpm in nitrogen, the coating film was irradiated with an electron beam under conditions of an acceleration voltage of 70 kv and an absorbed dose of 8000 Gy for 1.6 seconds. Subsequently, the temperature was raised from 25° C. to 125° C. over 30 seconds in nitrogen to perform heating of the coating film. The oxygen concentration of the atmosphere in the irradiation with an electron beam and the subsequent heating was 15 ppm. Next, a heating treatment was performed in the atmosphere at 100° C. for 30 minutes to thereby form a second charge-transporting layer (protective layer) cured by an electron beam, having a thickness of 5 μm.

A cylindrical electrophotographic photosensitive member before formation of convex portions on the surface (electrophotographic photosensitive member before formation of convex portions) was thus produced.

Formation of Convex Portions by Mold Pressure-Contact Shape Transfer

Figure 6A:
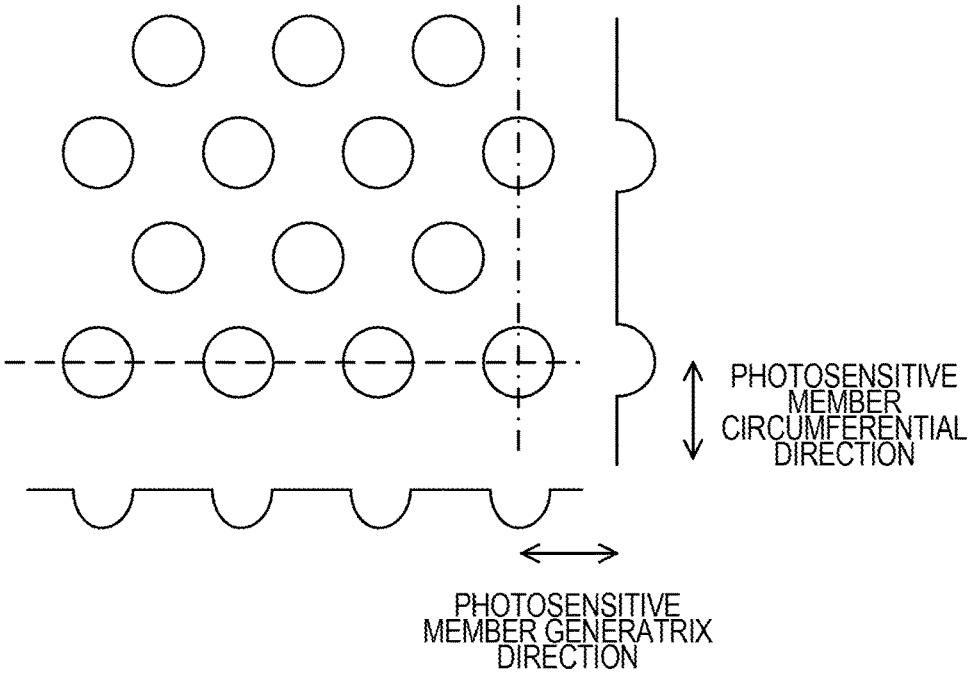
FIG. 6A is a view illustrating a mold member (mold) used in Production Examples of an electrophotographic photosensitive member.

A mold having a shape generally illustrated in FIG. 6A (in the present example, concave portions having a longest diameter L in the generatrix direction (referred to the longest diameter in the direction corresponding to the generatrix direction of the electrophotographic photosensitive member when concave portions on the mold were viewed from above. The same shall apply hereinafter.) of 45 μm, a longest diameter Lmin in the circumferential direction (referred to the longest diameter in the direction corresponding to the circumferential direction of the electrophotographic photosensitive member when concave portions on the mold were viewed from above. The same shall apply hereinafter.) of 45 μm, an area ratio of 50% and a depth D of 6 μm) as a mold was disposed on a pressure-contact shape transfer processing apparatus having a configuration generally illustrated in FIG. 4, and the electrophotographic photosensitive member produced, before formation of convex portions, was subjected to surface processing. The electrophotographic photosensitive member was rotated in the circumferential direction while the electrophotographic photosensitive member and a pressure member were pressed at a pressure of 20 MPa, thereby allowing convex portions to be formed on the entire surface (periphery) of the electrophotographic photosensitive member. In the processing, the temperatures of the electrophotographic photosensitive member and the mold were controlled so that the temperature of the surface of the electrophotographic photosensitive member was 120° C.

An electrophotographic photosensitive member having convex portions on the surface thereof was thus produced. The electrophotographic photosensitive member was defined as "photosensitive member-1".

Observation of Surface of Electrophotographic Photosensitive Member

The surface of the resulting electrophotographic photosensitive member (photosensitive member-1 ) was magnified and observed through a 50-magnification lens by a laser microscope (manufactured by Keyence Corporation, trade name: X-100), and convex portions provided on the surface of the electrophotographic photosensitive member were evaluated as described above. In the observation, adjustment was performed so that no inclination was generated in the longitudinal direction of the electrophotographic photosensitive member and the peak of the circle of the electrophotographic photosensitive member was focused on in the circumferential direction. A square region measuring 500 μm on a side (500 μm square) was obtained by connection of images magnified and observed, by an image connection application. With respect to the results obtained, the image-processing height data was selected by the attached image analysis software and subjected to filtering by a filter type median.

The height H1 of each of the convex portions, the longest diameter L1 thereof in the generatrix direction, the area ratio of the convex portions, and the like were determined by the above observation. All the convex portions present in ail the square regions measuring 500 μm square, subjected to measurement, were confirmed to have the same shape.

Furthermore, the rate of fitting was measured with respect to a photosensitive member produced under the same conditions as in photosensitive member- 1. A sample of about 5 mm square was arbitrarily cut out at 10 points in the surface of photosensitive member-1. The cross section thereof was roughly processed by a trimmer, and then set using an argon ion beam (trade name: SM-09010, manufactured by JEOL Ltd.). The cross section cut out, to which no vapor deposition was applied, was observed by a scanning electron microscope (trade name: S-4800 manufactured by Hitachi High-Technologies Corporation), and three points were arbitrarily selected for calculation of the rate of fitting.

The results are shown in Table 1.

Herein, the cross section was observed using a laser microscope (trade name: X-100, manufactured by Keyence Corporation), and the same results as in the case where the scanning electron microscope was used were obtained.

(Production Examples of Photosensitive Member-2 to Photosensitive Member-5)

Each of electrophotographic photosensitive members was produced in the same manner as in Production Example of photosensitive member-1 except that a mold shown in Table 1 was used for the mold in Production Example of photosensitive member-1. The resulting electrophotographic photosensitive members having convex portions on the surface thereof were defined as "photosensitive member-2" to "photosensitive member-5".

The surfaces of the resulting electrophotographic photosensitive members were observed in the same manner as in Production Example of photosensitive member-1. The results are shown in Table 1.

(Production Examples of Photosensitive Member-6 to Photosensitive Member-7)

Each of electrophotographic photosensitive members was produced in the same manner as in Production Example of photosensitive member-1 except that the thickness of the second charge-transporting layer was changed as shown in Table 1 and a mold shown in Table 1 was used for the mold in Production Example of photosensitive member-1. The resulting electrophotographic photosensitive members having convex portions on the surface thereof were defined as "photosensitive member-6" to "photosensitive, member-7".

The surfaces of the resulting electrophotographic photosensitive members -were observed in the same manner as in Production Example of photosensitive member-1. The results are shown in Table 1.

(Production Examples of Photosensitive Member-8 to Photosensitive Member-11)

Each of electrophotographic photosensitive members was produced in the same manner as in Production Example of photosensitive member-1 except that, in Production Example of photosensitive member-1, the temperature was raised from 25° C. to 100° C. over 0 seconds in the heating in nitrogen after irradiation with an electron beam, to perform heating of the coating film, additionally, the thickness of the second charge-transporting layer was changed as shown in Table 1, and furthermore a mold shown in Table 1 was used for the mold. The resulting electrophotographic photosensitive members having convex portions on the surface thereof were defined as "photosensitive member-8" to "photosensitive member-11".

The surfaces of the resulting electrophotographic photosensitive members were observed in the same manner as in Production Example of photosensitive member-1. The results are shown in Table 1.

(Production Examples of Photosensitive Member-12 to Photosensitive Member-13)

An electro-conductive layer, an undercoat layer, a charge-generating layer and a charge-transporting layer were formed on a support in the same manner as in Production Example of photosensitive member-1.

Next, convex portions were formed on the surface of the charge-transporting layer by using a mold shown in Table 1 for the mold. Thereafter, the charge-transporting layer was dip-coated with a coating liquid for a second charge-transporting layer, prepared in the same mariner except that the amount of the hole-transporting compound represented by structural formula (F) was 120 parts, to form a second charge-transporting layer (protective layer) having a thickness of 12 μm in the same manner as in Production Example of photosensitive member-1. Thus, each of electrophotographic photosensitive members having convex portions on the surface thereof was produced. The resulting electrophotographic photosensitive members were defined as "photosensitive member-12" to "photosensitive member-13".

The surfaces of the resulting electrophotographic photosensitive members were observed in the same manner as in Production Example of photosensitive member-1. The results are shown in Table 1.

(Production Examples of Photosensitive Member-14 to Photosensitive Member-15)

An electro-conductive layer, an undercoat layer, a charge-generating layer and a charge-transporting layer were formed on a support in the same manner as in Production Example of photosensitive member-1.

Next, convex portions were formed on the surface of the charge-transporting layer by using a mold shown in Table 1 for the mold, and thereafter a second charge-transporting layer (protective layer) having a thickness of 1 μm was formed in the same manner as in Production Example of photosensitive member-1. Thus, each of electrophotographic photosensitive members having convex portions on the surface thereof was produced. The resulting electrophotographic photosensitive members were defined as "photosensitive member-14" to "photosensitive member-15".

The surfaces of the resulting electrophotographic photosensitive members were observed in the same manner as in Production Example of photosensitive member-1. The results are shown in Table 1.

(Production Example of Photosensitive Member-16)

An electro-conductive layer, an undercoat layer, a charge-generating layer and a charge-transporting layer were formed on a support in the same manner as in Production Example of photosensitive member-1.

Next, an electrophotographic photosensitive member was produced in the same manner as in Production Example of photosensitive member-1 except that the charge-transporting layer was dip-coated with a coating liquid for a second charge-transporting layer, prepared in the same manner except that the amount of the hole-transporting compound represented by formula (P) was 120 parts, furthermore, the temperature was raised from 25° C. to 100° C. over 30 seconds in the heating in nitrogen after irradiation with an electron beam in Production Example of photosensitive member-1, to perform heating of the coating film, the thickness of the second charge-transporting layer was changed as shown in Table 1, and furthermore a mold shown in Table 1 was used for the mold. The resulting electrophotographic photosensitive member having convex portions on the surface thereof was defined, as "photosensitive member-16". The surface of the resulting electrophotographic photosensitive member was observed in the same manner as in Production Example of photosensitive member-1. The results are shown in Table 1.

(Production Examples of Photosensitive Member-17 to Photosensitive Member-18)

Each of electrophotographic photosensitive members was produced in the same manner as in Production Example of photosensitive member-1 except that an electro-conductive layer, an undercoat layer, a charge-generating layer and a charge-transporting layer were formed on a support in the same manner as in Production Example of photosensitive member-1, furthermore, the charge-transporting layer was dip-coated with a coating liquid for a second charge-transporting layer, prepared in the same manner as in Production Example of photosensitive member-1, furthermore, the temperature was raised from 25° C. to 100° C. over 30 seconds in the heating in nitrogen after irradiation of the second charge-transporting layer with an electron beam, to perform heating of the coating film, and furthermore a mold shown in Table 1 was used for the mold. The resulting electrophotographic photosensitive members having convex portions on the surface thereof were defined as "photosensitive member-17" to "photosensitive member-18".

The surfaces of the resulting electrophotographic photosensitive members were observed in the same manner as in Production Example of photosensitive member-1. The results are shown in Table 1.

(Production Examples of Photosensitive Member-19 to Photosensitive Member-20)

Each of electrophotographic photosensitive members was produced in the same manner as in Production Example of photosensitive member-1 except that the thickness of the second charge-transporting layer was changed as shown in Table 1 and a mold shown in Table 1 was used for the mold in Production Example of photosensitive member-1. The resulting electrophotographic photosensitive members having convex portions on the surface thereof were defined as "photosensitive member-19" to "photosensitive member-20".

The surfaces of the resulting electrophotographic photosensitive members were observed in the same manner as in Production Example of photosensitive member-1. The results are shown in Table 1.

(Production Example of Photosensitive Member-21)

Figure 6B:
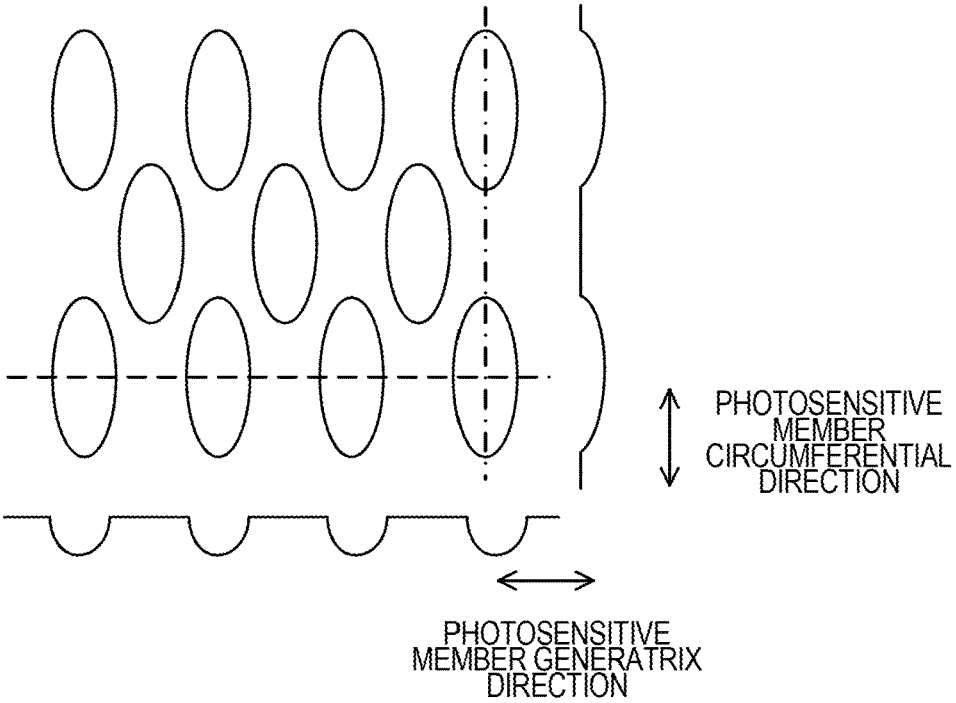
FIG. 6B is a view illustrating a mold member (mold) used in Production Examples of an electrophotographic photosensitive member.

A cylindrical electrophotographic photosensitive member before formation of convex portions on the surface (electrophotographic photosensitive member before formation of convex portions) was produced in the same manner as in Production Example of photosensitive member-1. Next, an electrophotographic photosensitive member was produced in the same manner as in Production Example of photosensitive member-1 except that a mold having a shape illustrated in FIG. 6B was used for the mold. The resulting electrophotographic photosensitive member having convex portions on the surface thereof was defined as "photosensitive member-21".

The surface of the resulting electrophotographic photosensitive member was observed in the same manner as in Production Example of photosensitive member-1. The results are shown in Table 1.

(Production Example of Photosensitive Member-22)

A cylindrical electrophotographic photosensitive member before formation of convex portions on the surface (electrophotographic photosensitive member before formation of convex portions) was produced in the same manner as in Production Example of photosensitive member-1. Next, an electrophotographic photosensitive member was produced in the same manner as in Production Example of photosensitive member-1 except that a mold having a shape illustrated in FIG. 6 B was used for the mold. The resulting electrophotographic photosensitive member having convex portions on the surface thereof was defined as "photosensitive member-22".

The surface of the resulting electrophotographic photosensitive member was observed in the same manner as in Production Example of photosensitive member-1. The results are shown in Table 1.

(Production Example of Photosensitive Member-23)

An electro-conductive layer, an undercoat layer, a charge-generating layer and a charge-transporting layer were formed on a support in the same manner as in Production Example of photosensitive member-1. Next, a mixed solvent of 20 parts of 1,1,2,2,3,3,4-heptafluorocyclopentane (trade name: Zeorola H)/20 parts of 1-propanol was subjected to filtration by a polyflon filter (trade name: PF-040, produced by Toyo Roshi Kaisha, Ltd.). Thereafter, 30 parts of the hole-transporting compound represented by formula (F), 70 parts of 1,1,2,2,3,3,4-heptafluorocyclopentane, 70 parts of 1-propanol and 10 parts of an alumina fine particle (average particle size: 0.1 μm, trade name; LS-231, produced by Nippon Light Metal Co., Ltd,) were added to the mixed solvent. The resultant was treated by a high pressure disperser (trade name: Microfluidizer M-110EK, manufactured by Microfluidics in U.S.) at a pressure of 600 kgf/cm$^2$ three times, and thereafter filtered by a polyflon filter (trade name: PP-020, produced by Toyo Roshi Kaisha, Ltd.) to thereby prepare a coating liquid for a second charge-transporting layer (protective layer). The charge-transporting layer was dip-coated with the coating liquid for a second charge-transporting layer, and the resulting coating film was dried in the atmosphere at 50° C. for 6 minutes. Thereafter, while the support (object to be irradiated) was rotated at 200 rpm in nitrogen, the coating film was irradiated with an electron beam under conditions of an acceleration voltage of 70 kV and an absorbed dose of 8000 Gy for 1.6 seconds. Subsequently, the temperature was raised from 25° C. to 125° C. over 30 seconds in nitrogen, to perform heating of the coating film. The oxygen concentration in the atmosphere in the irradiation with an electron beam and the subsequent heating was 15 ppm. Next, a heating treatment was performed in the atmosphere at 100° C. for 30 minutes to thereby form a second charge-transporting layer (protective layer) cured by an electron beam, having a thickness of 5 μm.

Next, an electrophotographic photosensitive member was produced in the same manner as in Production Example of photosensitive member-1 that a mold having a shape shown in Table 1 was used for the mold.

The resulting electrophotographic photosensitive member having convex portions on the surface thereof was defined as "photosensitive member-23".

The surface of the resulting electrophotographic photosensitive member was observed in the same manner as in Production Example of photosensitive member-1. The results are shown in Table 1.

(Production Examples of Photosensitive Member-24 to Photosensitive Member-25)

An electro-conductive layer, an undercoat layer, a charge-generating layer and a charge-transporting layer were formed on a support in the same manner as in Production Example of photosensitive member-1.

Next, 0.5 parts of a fluorine atom-containing resin (trade name: GF-300, produced by Toagosei Co., Ltd.) as a dispersant was dissolved in a mixed solvent of 30 parts of 1,1,2,2,3,3,4-heptafluorocyclopentane (trade name; Zeorola H5/30 parts of 1-propanol, and thereafter 10 parts of polytetrafluoroethylene (trade name: Ruburon L-2, produced by Daikin Industries Ltd.) as a lubricant was added thereto. The resultant was loaded to a high pressure disperser (trade name: Microfluidizer M-110EH, manufactured by Microfluidics in U.S.), and subjected to a dispersing treatment at a pressure of 600 kgf/cm$^2$ four times. The resultant was filtered by a polyflon filter (trade name: PF-040, produced by Toyo Roshi Kaisha, Ltd.) to thereby provide a lubricant dispersion. Thereafter, 90 parts of the hole-transporting compound represented by formula (F), 70 parts of 1,1,2,2,3,3,4-heptafluorocyclopentane and 70 parts of 1-propanol were added to the lubricant dispersion. The resultant was filtered by a polyflon filter (trade name: PF-020, produced by Toyo Roshi Kaisha, Ltd.) to thereby prepare a coating liquid for a second charge-transporting layer (protective layer). The charge-transporting layer was dip-coated with the coating liquid for a second charge-transporting layer, and the resulting coating film was dried in the atmosphere at 50° C. for 10 minutes. Thereafter, while the support was rotated at 200 rpm under conditions of an acceleration voltage of 150 kV and a beam current of 3.0 mA in nitrogen, the coating film was irradiated with an electron beam for 1.6 seconds. The absorbed dose of the electron bean here was measured and found to be 15 kGy. Subsequently, the temperature was raised from 25° C. to 125° C. over 30 seconds in nitrogen, to perform heating of the coating film. The oxygen concentration in the atmosphere in the irradiation with an electron beam and the subsequent heat-curing reaction was 15 ppm or less. Next, the coating film was naturally cooled to 25° C. in the atmosphere, and heat-treated in the atmosphere at 100° C. for 30 minutes to thereby form a second charge-transporting layer (protective layer) having a thickness of 5 μm. Thus, a cylindrical electrophotographic photosensitive member before formation of convex portions on the surface (electrophotographic photosensitive member before formation of convex portions) was produced.

Next, each of electrophotographic photosensitive members was produced in the same manner as in Production Example of photosensitive member-1 except that a mold shown in Table 1 was used for the mold. The resulting electrophotographic photosensitive members having convex portions on the surface thereof: were defined as "photosensitive member-24" to "photosensitive member-25".

The surfaces of the resulting electrophotographic photosensitive members were observed in the same manner as in Production Example of photosensitive member-1. The results are shown in Table 1.

(Production Example of Photosensitive Member-26)

An electrophotographic photosensitive member was produced in the same manner as in Production Example of photosensitive member-1 except that a mold shown in Table 1 was used for the mold in Production Example of photosensitive member-1. The resulting electrophotographic photosensitive member having convex portions on the surface thereof was defined as "photosensitive member-26".

The surface of the resulting electrophotographic photosensitive member was observed in the same manner as in Production Example of photosensitive member-1. The results are shown in Table 1.

TABLE 1

| | Mold | | | | Photosensitive member | | | | | | | |
|---|---|---|---|---|---|---|---|---|---|---|---|---|
| | Longest diameter in gerneratrix direction [μm] | Longest diameter in circum-ferential direction [μm] | Depth [μm] | Area ratio of concave portion [%] | Longest diameter in generatrix direction [μm] | Longest diameter in circum-ferential direction [μm] | Height [μm] | Rate of fitting (H2/H1') minimun | Rate of fitting (H2/H1') maximum | Area ratio of convex portion [%] | Thickness of surface layer T[μm] | L/T |
| Photosensitive member 1 | 45 | 45 | 6 | 70 | 45 | 45 | 2 | 75 | 79 | 70 | 5 | 4.0 |
| Photosensitive member 2 | 80 | 30 | 6 | 70 | 80 | 30 | 2 | 72 | 76 | 70 | 5 | 6.0 |
| Photosensitive member 3 | 65 | 65 | 5 | 50 | 65 | 65 | 2 | 71 | 79 | 30 | 5 | 13.0 |
| Photosensitive member 4 | 30 | 30 | 6 | 70 | 30 | 30 | 2 | 70 | 76 | 30 | 5 | 6.0 |
| Photosensitive member 5 | 60 | 65 | 6 | 30 | 30 | 30 | 2 | 71 | 74 | 30 | 5 | 6.0 |
| Photosensitive member 6 | 35 | 35 | 6 | 30 | 35 | 35 | 2 | 70 | 73 | 35 | 8 | 4.4 |
| Photosensitive member 7 | 40 | 40 | 6 | 50 | 40 | 40 | 2 | 85 | 87 | 50 | 2 | 20.0 |
| Photosensitive member 8 | 30 | 30 | 4 | 30 | 30 | 30 | 1 | 80 | 23 | 30 | 1.3 | 23.1 |
| Photosensitive member 9 | 60 | 60 | 4 | 30 | 60 | 60 | 1 | 22 | 89 | 30 | 1.3 | 40.0 |
| Photosensitive member 10 | 30 | 30 | 4 | 65 | 50 | 30 | 1 | 20 | 23 | 65 | 1.3 | 23.1 |
| Photosensitive member 11 | 60 | 60 | 4 | 65 | 60 | 60 | 1 | 22 | 21 | 65 | 1.3 | 40.0 |
| Photosensitive member 12 | 30 | 30 | 3 | 30 | 30 | 30 | 1 | 190 | 200 | 30 | 12 | 2.5 |
| Photosensitive member 13 | 30 | 50 | 3 | 65 | 30 | 30 | 1 | 190 | 200 | 65 | 12 | 2.5 |
| Photosensitive member 14 | 60 | 60 | 3 | 30 | 60 | 60 | 1 | 195 | 200 | 30 | 1 | 60.0 |
| Photosensitive member 15 | 60 | 60 | 3 | 65 | 60 | 60 | 1 | 198 | 800 | 65 | 1 | 60.0 |
| Photosensitive member 16 | 30 | 30 | 6 | 50 | 30 | 30 | 6 | 52 | 35 | 50 | 11 | 2.7 |
| Photosensitive member 17 | 60 | 60 | 5 | 50 | 60 | 60 | 3 | 80 | 61 | 50 | 2.5 | 24.0 |
| Photosensitive member 18 | 80 | 80 | 5 | 50 | 80 | 80 | 2 | 95 | 56 | 50 | 3 | 26.0 |
| Photosensitive member 19 | 30 | 30 | 6 | 50 | 30 | 30 | 2 | 79 | 80 | 50 | 8 | 3.8 |
| Photosensitive member 20 | 45 | 45 | 6 | 80 | 45 | 45 | 2 | 90 | 92 | 50 | 2 | 31.9 |
| Photosensitive member 21 | 30 | 100 | 6 | 80 | 30 | 100 | 2 | 88 | 93 | 50 | 5 | 8.0 |
| Photosensitive member 22 | 21 | 500 | 6 | 80 | 21 | 500 | 2 | 86 | 95 | 50 | 5 | 8.3 |
| Photosensitive member 23 | 30 | 30 | 6 | 80 | 30 | 40 | 2 | 85 | 90 | 50 | 5 | 8.9 |

TABLE 1-continued

| | Mold | | | | Photosensitive member | | | | | | | |
|---|---|---|---|---|---|---|---|---|---|---|---|---|
| | Longest diameter in gerneratrix direction [μm] | Longest diameter in circum-ferential direction [μm] | Depth [μm] | Area ratio of concave portion [%] | Longest diameter in generatrix direction [μm] | Longest diameter in circum-ferential direction [μm] | Height [μm] | Rate of fitting (H2/H1') minimun | Rate of fitting (H2/H1') maximum | Area ratio of convex portion [%] | Thickness of surface layer T[μm] | L/T |
| Photosensitive member 24 | 45 | 45 | 6 | 50 | 45 | 45 | 2 | 88 | 91 | 95 | 5 | 9.8 |
| Photosensitive member 25 | 30 | 30 | 6 | 50 | 30 | 30 | 2 | 72 | 93 | 50 | 5 | 6.0 |
| Photosensitive member 26 | 45 | 45 | 6 | 50 | 45 | 45 | 2 | 75 | 79 | 30 | 5 | 9.0 |

Experimental evaluation of electrophotographic photosensitive member

Example 1

Photosensitive member-1 was mounted on a cyan station of an altered electrophotographic apparatus (copier) (trade name: iR-ADV C5255) manufactured by Canon Inc. as an evaluation apparatus, and tested and evaluated as follows.

First, conditions of a charging apparatus and an image exposure apparatus were set so that the dark portion potential (Vd) and the bright portion potential (V1) of the electrophotographic photosensitive member were −700 V and −200 V, respectively, in an environment of 5° C./5% RH, to adjust the initial potential of the electrophotographic photosensitive member.

Next, a cleaning blade made of a polyurethane rubber, having a hardness of 77°, was set at an abutting angle of 28° and an abutting pressure of 30 g/cm to the surface of the electrophotographic photosensitive member. First, an A4 horizontal solid image was continuously output for five sheets under an environment of 10° C./5% RH in the state where a heater (drum heater) for the electrophotographic photosensitive member was turned off. Subsequently, an evaluation chart of an image having a printing rate of 1% was continuously output for 50000 sheets, and thereafter a screen image having a. cyan density of 30% was output as a halftone image. The cleanability was rated using five images initially output, and the blank area on each of images was rated using the screen image having a cyan density of 30% as a halftone image, as follows. The results tire shown in Table 3.

Rating of Cleanability

A: No stripes due to slipping were present on image.

B: Slipping was partially caused, but acceptable on image.

Rating of Blank Area

A: No blank areas were generated seven when image was magnified and observed,

B: Image on which blank areas seemed to be present was obtained when magnified and observed, but such image could, not be confirmed clearly, C: Extremely slight blank areas could be slightly observed when image was magnified and observed, D: slight blank areas were generated at end portion of image.

E: Clear blank areas were generated regardless of center and end portion of image.

Examples 2 to 56

Experimental evaluation of each of the electrophotographic photosensitive members was performed in the same manner as in Example 1 except that a member shown in Table 2 was used for the electrophotographic photosensitive member, and the hardness and the settings (abutting angle and abutting pressure) of the cleaning blade were as shown in Table 2. The results are shown in Table 2.

TABLE 2

| | Photosensitive member | | | | Rating | |
|---|---|---|---|---|---|---|
| | Photosensitive member | Hardness [°] | Abutting angle [°] | Abutting pressure [g/cm] | Cleanability | Blank area |
| Example 1 | Photosensitive member-1 | 77 | 28 | 30 | A | A |
| Example 2 | Photosensitive member-2 | 77 | 28 | 30 | A | A |
| Example 3 | Photosensitive member-3 | 77 | 28 | 30 | A | A |
| Example 4 | Photosensitive member-4 | 77 | 28 | 30 | A | A |
| Example 5 | Photosensitive member-5 | 77 | 28 | 30 | A | A |
| Example 6 | Photosensitive member-6 | 77 | 28 | 30 | A | A |
| Example 7 | Photosensitive member-7 | 77 | 28 | 30 | A | A |
| Example 8 | Photosensitive member-8 | 77 | 28 | 30 | A | D |
| Example 9 | Photosensitive member-9 | 77 | 28 | 30 | A | D |
| Example 10 | Photosensitive member-10 | 77 | 28 | 30 | A | D |
| Example 11 | Photosensitive member-11 | 77 | 28 | 30 | A | D |
| Example 12 | Photosensitive member-12 | 77 | 28 | 30 | A | D |
| Example 13 | Photosensitive member-13 | 77 | 28 | 30 | A | D |
| Example 14 | Photosensitive member-14 | 77 | 28 | 30 | A | D |
| Example 15 | Photosensitive member-15 | 77 | 28 | 30 | A | D |
| Example 16 | Photosensitive member-16 | 77 | 28 | 30 | A | C |
| Example 17 | Photosensitive member-17 | 77 | 28 | 30 | A | C |

TABLE 2-continued

| | Photosensitive member | | | | Rating | |
|---|---|---|---|---|---|---|
| | Photosensitive member | Hardness [°] | Abutting angle [°] | Abutting pressure [g/cm] | Cleanability | Blank area |
| Example 18 | Photosensitive member-18 | 77 | 28 | 30 | A | C |
| Example 19 | Photosensitive member-19 | 77 | 28 | 30 | A | B |
| Example 20 | Photosensitive member-20 | 77 | 28 | 30 | A | B |
| Example 21 | Photosensitive member-21 | 77 | 28 | 30 | A | A |
| Example 22 | Photosensitive member-22 | 77 | 28 | 30 | A | A |
| Example 23 | Photosensitive member-23 | 77 | 28 | 30 | A | A |
| Example 24 | Photosensitive member-24 | 77 | 28 | 30 | A | A |
| Example 25 | Photosensitive member-25 | 77 | 28 | 30 | A | A |
| Example 26 | Photosensitive member-26 | 77 | 28 | 30 | A | A |
| Example 27 | Photosensitive member-1 | 65 | 28 | 30 | A | A |
| Example 28 | Photosensitive member-2 | 65 | 28 | 30 | A | A |
| Example 29 | Photosensitive member-3 | 65 | 28 | 30 | A | A |
| Example 30 | Photosensitive member-4 | 65 | 28 | 30 | A | A |
| Example 31 | Photosensitive member-5 | 65 | 28 | 30 | A | A |
| Example 32 | Photosensitive member-10 | 65 | 28 | 30 | A | D |
| Example 33 | Photosensitive member-11 | 65 | 28 | 30 | A | D |
| Example 34 | Photosensitive member-14 | 65 | 28 | 30 | A | D |
| Example 35 | Photosensitive member-15 | 65 | 28 | 30 | A | D |
| Example 36 | Photosensitive member-1 | 80 | 28 | 30 | A | A |
| Example 37 | Photosensitive member-2 | 80 | 28 | 30 | A | A |
| Example 38 | Photosensitive member-3 | 80 | 28 | 30 | A | A |
| Example 39 | Photosensitive member-4 | 80 | 28 | 30 | A | A |
| Example 40 | Photosensitive member-5 | 80 | 28 | 30 | A | A |
| Example 41 | Photosensitive member-10 | 80 | 28 | 30 | A | D |
| Example 42 | Photosensitive member-11 | 80 | 28 | 30 | A | D |
| Example 43 | Photosensitive member-14 | 80 | 28 | 30 | A | D |
| Example 44 | Photosensitive member-15 | 82 | 28 | 30 | A | D |
| Example 45 | Photosensitive member-2 | 77 | 28 | 40 | A | A |
| Example 46 | Photosensitive member-3 | 77 | 28 | 40 | A | A |
| Example 47 | Photosensitive member-4 | 77 | 28 | 40 | A | A |
| Example 48 | Photosensitive member-5 | 77 | 28 | 40 | A | A |
| Example 49 | Photosensitive member-10 | 77 | 28 | 40 | A | D |
| Example 50 | Photosensitive member-11 | 77 | 28 | 40 | A | D |
| Example 51 | Photosensitive member-2 | 77 | 28 | 20 | A | A |
| Example 52 | Photosensitive member-3 | 77 | 28 | 20 | A | A |
| Example 53 | Photosensitive member-4 | 77 | 28 | 20 | A | A |
| Example 54 | Photosensitive member-5 | 77 | 28 | 20 | A | A |
| Example 55 | Photosensitive member-10 | 77 | 28 | 20 | A | D |
| Example 56 | Photosensitive member-11 | 77 | 28 | 20 | A | D |

(Production Examples of Photosensitive Member-101 to Photosensitive Member-103)

Each of cylindrical electrophotographic photosensitive members before formation of convex portions on the surface (electrophotographic photosensitive members before formation of convex portions) was produced. Next, 410 parts of 1,1,2,2,3,3,4-heptafluorocyclopentane and 410 pares of 1-propanol were further added to the coating liquid for a second charge-transporting layer in Production Example of photosensitive member-1. The second charge-transporting layer was spray-coated with the coating liquid for a second charge-transporting layer, while the conditions were changed, to produce each of electrophotographic photosensitive members having convex portions on the surface thereof. The resulting electrophotographic photosensitive members having convex portions on the surface thereof were defined as "photosensitive member-101" to "photosensitive member-103".

The surfaces of the resulting electrophotographic photosensitive members were observed in the same manner as in Production Example of photosensitive member-1. The results are shown in Table 3. The heights H1, the longest diameters L1 in the generatrix direction and the longest diameters L2 in the circumferential direction of convex portions formed on the surface of each of photosensitive member-101 to photosensitive member-103 were not uniform. Therefore, the heights H1, the longest diameters L1 in the generatrix direction and the longest diameters L2 in the circumferential direction shown in Table 3 were the average values in a square region measuring 500 μm square.

(Production Example of Photosensitive Member-104)

An electro-conductive layer, an undercoat layer, a charge-generating layer and a charge-transporting layer were formed on a support in the same manner as in Production Example of photosensitive member-1.

Next, the charge-transporting layer was dip-coated with the coating liquid for a second charge-transporting layer in the same manner as in Production Example of photosensitive member-1, and thereafter the resulting coating film was dried in the atmosphere at 100° C. for 6 minutes. Thereafter, the electrophotographic photosensitive member was rotated in the circumferential direction while the electrophotographic photosensitive member and a pressure member were pressed at a pressure of 0.5 MPa by using the apparatus illustrated in FIG. 4 and the mold shown in Table 1, thereby allowing convex portions to be formed on the entire surface (periphery) of the electrophotographic photosensitive member. The temperatures of the electrophotographic photosensitive member and the mold were controlled in such processing so that the temperature of the surface of the electrophotographic photosensitive member was 40° C.

Thereafter, while the support (object to be irradiated) was rotated at 200 rpm in nitrogen, the coating film was irradiated with an electron beam under conditions of an acceleration voltage of 70 kv and an absorbed dose of 8000 Gy for 1.6 seconds. Subsequently, the temperature was raised from 25° C. to 125° C. over 30 seconds in nitrogen, to perform heating of the coating film. The oxygen concentration in the atmosphere in the irradiation with an electron beam and the subsequent heating was 15 ppm. Next, a heating treatment was performed in the atmosphere at 100° C. for 30 minutes to thereby form a second charge-transporting layer (protective layer) cured by an electron beam, having a thickness of 5 μm.

Thus, an electrophotographic photosensitive member having convex portions on the surface was produced. The electrophotographic photosensitive member was defined as "photosensitive member-104".

The surface of the resulting electrophotographic photosensitive member was observed in the same manner as in Production Example of photosensitive member-1. The results are shown in Table 3.

(Production Example of Photosensitive Member-105)

An electrophotographic photosensitive member was produced in the same manner as in Production Example of photosensitive member-1 except that a mold shown in Table 1 was used for the mold in Production Example of photosensitive member-1. The resulting electrophotographic photosensitive member having convex portions on the surface thereof was defined as "photosensitive member-105".

The surface of the resulting electrophotographic photosensitive member was observed in the same manner as in Production Example of photosensitive member-1. The results are shown in Table 3.

TABLE 3

| | Mold | | | | Photosensitive member | | | | | | | |
|---|---|---|---|---|---|---|---|---|---|---|---|---|
| | Longest diameter in gerneratrix direction [μm] | Longest diameter in circum-ferential direction [μm] | Depth [μm] | Area ratio of concave portion [%] | Longest diameter in generatrix direction [μm] | Longest diameter in circum-ferential direction [μm] | Height [μm] | Rate of fitting (H2/H1') minimun | Rate of fitting (H2/H1') maximum | Area ratio of convex portion [%] | Thickness of surface layer T[μm] | L/T |
| Photosensitive member 101 | — | — | — | — | 34 | 42 | 2 | 0 | 0 | 48 | 5 | 6.8 |
| Photosensitive member 102 | — | — | — | — | 41 | 55 | 2 | 0 | 0 | 54 | 5 | 8.2 |
| Photosensitive member 103 | — | — | — | — | 58 | 67 | 2 | 0 | 0 | 62 | 5 | 11.6 |
| Photosensitive member 104 | 35 | 35 | 2 | 50 | 32 | 34 | 2 | 0 | 0 | 50 | 5 | 6.4 |
| Photosensitive member 105 | 20 | 20 | 6 | 50 | 20 | 20 | 2 | 86 | 91 | 50 | 5 | 4.0 |

Comparative Examples 1 to 5

Experimental evaluation of each of the electrophotographic photosensitive members was performed in the same manner as in Example 1 except that a member shown in Table 4 was used for the photosensitive member, and the hardness and the settings (abutting angle and abutting pressure) of the cleaning blade were as shown in Table 4. The results are shown in Table 4.

TABLE 4

| | Photosensitive member | | | | Rating | |
|---|---|---|---|---|---|---|
| | Photosensitive member | Hard-ness [°] | Abutting angle [°] | Abutting pressure [g/cm] | Clean-ability | Blank area |
| Comparative Example 1 | Photosensitive member-101 | 77 | 28 | 30 | A | E |
| Comparative Example 2 | Photosensitive member-102 | 77 | 28 | 30 | A | E |
| Comparative Example 3 | Photosensitive member-103 | 77 | 28 | 30 | A | E |
| Comparative Example 4 | Photosensitive member-104 | 77 | 28 | 30 | A | E |
| Comparative Example 5 | Photosensitive member-105 | 77 | 28 | 30 | B | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An electrophotographic photosensitive member having cylindrical shape, the electrophotographic photosensitive member comprising an electroconductive support and a surface layer on the electroconductive support, and comprising a layer immediately below the surface layer, between the electroconductive support and the surface layer, wherein a plurality of convex portions having a longest diameter L1 in a generatrix direction of the electrophotographic photosensitive member of 30 μm or more and a height H1 of 1 μm or more are formed on a surface of the electrophotographic photosensitive member, a plurality of convex portions corresponding to the convex portions on a surface of the surface layer are formed at an interface between the surface layer and the layer immediately below the surface layer, a rate of fitting of the convex portions on the surface of the surface layer to the convex portions formed at the interface between the surface layer and the layer immediately below the surface layer is 20% to 200%, and a ratio of an area of the convex portions on the surface to an area of the surface is 30% to 70%.

2. The electrophotographic photosensitive member according to claim 1, wherein the rate of fitting is 50% to 100%.

3. The electrophotographic photosensitive member according to claim 1, wherein a relationship between L1 (μm) and T (μm) satisfies $3 \leq L1/T \leq 22$ when T is a thickness of the surface layer.

4. The electrophotographic photosensitive member according to claim 3, wherein $4 \leq L1/T \leq 20$.

5. The electrophotographic photosensitive member according to claim 1, wherein the thickness of the surface layer is 0.1 to 30 μm.

6. The electrophotographic photosensitive member according to claim 1, wherein the surface layer is a cured layer.

7. A method for producing an electrophotographic photosensitive member, the electrophotographic photosensitive member having cylindrical shape and comprising an electroconductive support, a surface layer on the electroconductive support, and a layer immediately below the surface layer between the electroconductive support and the surface layer, the method comprising:

forming the surface layer to produce an object to be processed; and pressing a mold member having concave portions on a surface of the surface layer and rotating the object to be processed, to form a plurality of convex portions on the surface of the surface layer and to form a plurality of convex portions corresponding to the convex portions at an interface between the surface layer and the layer immediately below the surface layer, wherein plurality of convex portions having a longest diameter L1 in a generatrix direction of the electrophotographic photosensitive member of 30 μm or more and a height H1 of 1 μm or more are formed on a surface of the electrophotographic photosensitive member, a plurality of convex portions corresponding to the convex portions on a surface of the surface layer are formed at an interface between the surface layer and the layer immediately below the surface layer, and a rate of fitting of the convex portions on the surface of the surface layer to the convex portions formed at the interface between the surface layer and the layer immediately below the surface layer is 20 to 200%.

8. The method for producing an electrophotographic photosensitive member according to claim 7, wherein a ratio of an area of the convex portions on the surface to an area of the surface is 30% to 70%.

9. A process cartridge detachably attachable to a main body of an electrophotographic apparatus, wherein the process cartridge integrally supports an electrophotographic photosensitive member having cylindrical shape, and a cleaning unit having a cleaning member disposed in contact with the electrophotographic photosensitive member, the electrophotographic photosensitive member comprising an electroconductive support and a surface layer on the electroconductive support, with a layer immediately below the surface layer between the electroconductive support and the surface layer, wherein a plurality of convex portions having a longest diameter L1 in a generatrix direction of the electrophotographic photosensitive member of 30 μm or more and a height H1 of 1 μm or more are formed on a surface of the electrophotographic photosensitive member, a plurality of convex portions corresponding to the convex portions on a surface of the surface layer are formed at an interface between the surface layer and the layer immediately below the surface layer, a rate of fitting of the convex portions on the surface of the surface layer to the convex portions formed at the interface between the surface layer and the layer immediately below the surface layer is 20 to 200%, and a ratio of an area of the convex portions on the surface to an area of the surface is 30% to 70%.

10. An electrophotographic apparatus comprising an electrophotographic photosensitive member having cylindrical shape, a charging unit, an exposure unit, a developing unit, a transferring unit and a cleaning unit having a cleaning member disposed in contact with the electrophotographic photosensitive member, the electrophotographic photosensitive member comprises an electroconductive support and a surface layer on the electroconductive support, with a layer immediately below the surface layer between the electroconductive support and the surface layer, wherein a plurality of convex portions having a longest diameter L1 in a generatrix direction of the electrophotographic photosensitive member of 30 μm or more and a height H1 of 1 μm or more are formed on a surface of the electrophotographic photosensitive member, a plurality of convex portions corresponding to the convex portions on a surface of the surface layer are formed at an interface between the surface layer and the layer immediately below the surface layer, a rate of fitting of the convex portions on the surface of the surface layer to the convex portions formed at the interface between the surface layer and the layer immediately below the surface layer is 20 to 200%, and a ratio of an area of the convex portions on the surface to an area of the surface is 30% to 70%.

* * * * *